US006942734B2

(12) United States Patent
Rata et al.

(10) Patent No.: US 6,942,734 B2
(45) Date of Patent: Sep. 13, 2005

(54) TREATMENT EQUIPMENT

(75) Inventors: Iikka Rata, Jyväskylä (FI); Reijo Hassinen, Leppävesi (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/887,041

(22) Filed: Jul. 8, 2004

(65) Prior Publication Data

US 2004/0237884 A1 Dec. 2, 2004

Related U.S. Application Data

(63) Continuation-in-part of application No. 10/369,897, filed on Feb. 20, 2003, now abandoned.

(51) Int. Cl.[7] ..... B05C 11/02

(52) U.S. Cl. ..... 118/123; 118/126; 118/261; 118/413

(58) Field of Search ..... 118/118, 119, 118/123, 126, 261, 413; 162/281; 15/256.51; 101/365; 427/356

(56) References Cited

U.S. PATENT DOCUMENTS 4,241,691 A * 12/1980 Hopfe et al. ..... 118/126
6,139,638 A * 10/2000 Dubois et al. ..... 118/413

FOREIGN PATENT DOCUMENTS

DE 1151433 * 7/1963

* cited by examiner

*Primary Examiner*—Laura Edwards
(74) *Attorney, Agent, or Firm*—Fildes & Outland, P.C.

(57) ABSTRACT

A treatment equipment, which is intended to be installed in connection with a moving surface. The treatment equipment includes a frame and a blade holder formed from composite material as a single piece and connected to the frame. In addition, a blade is fitted to the blade holder, the bevelled edge belonging to which is arranged to be brought into contact with the moving surface by moving the blade holder. In the blade holder, there is also a separate backing blade, which is fitted at one edge into the blade holder, the other edge extending closer than the blade holder to the said bevelled edge.

12 Claims, 8 Drawing Sheets

TREATMENT EQUIPMENT

CROSS REFERENCE TO RELATED APPLICATION

This application is a continuation-in-part of application Ser. No. 10/369,897 filed Feb. 20, 2003 now abandoned.

FIELD OF THE INVENTION

The present invention relates to treatment equipment, which is intended to be installed in connection with a moving surface, and which treatment equipment includes

- a frame, which is arranged in the vicinity of the said surface,
- a blade holder, which is connected to the frame,
- a blade fitted to the blade holder, the bevelled edge of which blade is arranged to be brought into contact with the moving surface by moving the blade holder, and
- a separate backing blade, which is fitted at one edge into the blade holder, the other edge extending closer than the blade holder to the said bevelled edge.

BACKGROUND OF THE INVENTION

The treatment equipment according to the invention is used particularly in paper machines and in other web-forming machines. In present treatment equipment, the blade holder is made from metal and includes many components attached to each other. The blade holder is attached to the frame and includes a jaw component, in which there is a throat for a blade. Metal and composite blades are generally used, but plastic blades are also possible. Usually, the blade is used to doctor the moving surface or to smooth a substance spread on the moving surface.

Metal blade holders are heavy and require a load-bearing frame. In addition, metal blade holders are rigid, so that they conform poorly to the profile of the surface. In addition, composite blades become scratched in a metal blade holder during blade changing. In addition to the above, the manufacture of the blade holder requires numerous machining stages. In addition, the attachment devices holding the components of the blade holder together can become detached during use, causing process problems. The attachment devices also easily gather dirt.

DE patent number 1,151,433 discloses a blade holder, in which there is also a backing blade. The backing blade is used to support the blade, which is significant especially when using thick but soft plastic blades. The backing blade can then be used to transmit sufficient force to the actual blade.

SUMMARY OF THE INVENTION

The invention is intended to create a new type of treatment equipment, which is easier than before to manufacture, operate, and service, but which is also lighter than before and conforms better to the profile of the surface.

Accordingly, treatment equipment, which is intended to be installed in connection with a moving surface and which treatment equipment includes a frame, which is arranged in the vicinity of the said surface, a blade holder, formed from composite material as a single piece and connected to the frame, a blade fitted to the blade holder, the bevelled edge of which blade is arranged to be brought into contact with the moving surface by moving the blade holder, and a separate backing blade fitted to the blade holder, which is fitted at one edge into the blade holder, the other edge extending closer than the blade holder to the said bevelled edge.

The composite material of the backing blade may include reinforcing fibres, of which more than 60% are arranged to run in the lateral direction of the blade. The backing blade may be similar to the blade and also that, in its edge to be fitted into the blade holder, a shape-locking recess is formed for attaching the backing blade detachably to the blade holder.

In an arrangement the blade holder includes at least two attachment points for the recess for adjusting the position of the blacking blade in the lateral direction of the blade.

The blade holder may be arranged detachably in the frame, by means of a locking-shape pair of attachment counter-pieces, in which the shape-locking is arranged to hold the blade in its lateral direction and to be essentially free in the longitudinal direction of the blade. The first attachment counter-piece of the pair of attachment counter-pieces may be a shaped protrusion, which the second attachment counter-piece is arranged to cover essentially from the opposite sides. The attachment counter-piece may be arranged in the rear part parallel to the blade holder, the blade being attached to the front part of the blade holder. One attachment counter-piece of the pair of attachment counter-pieces may be arranged in a separate adapter piece, which is intended to be attached to the frame. One attachment counter-piece of the pair of attachment counter-pieces may be arranged in the frame.

The attachment counter-pieces may further be arranged to form an operational pivot between them, so that the angle between the attachment counter-pieces can be changed while the possible lateral locking of the blade remains unchanged. There may be loading means between the attachment counter-piece and the blade holder and in either or both of the attachment counter-pieces there is at least one recess for the loading members.

The loading members may comprise loading hoses and/or spring pieces.

In the treatment equipment according to the invention, advantageous characteristics are created by the surprising construction and material of the blade holder in the treatment equipment according to the invention. The blade holder is light and is suitable for various kinds of blade. In addition, the blade holder is simple to install and change. Despite the surprising construction, loading members, for example, can also be arranged in the blade holder. The blade holder can also be easily retrofitted to existing treatment equipment, without major alterations. On the other hand, new treatment equipment can be designed to be simpler than before. In addition, by suitable dimensioning and shaping, the components of the treatment equipment can be changed independently of each other, allowing the properties of the treatment equipment to be adjusted precisely as desired.

These and other features and advantages of the invention will be more fully understood from the following detailed description of the invention taken together with the accompanying drawings.

DETAILED DESCRIPTION OF THE INVENTION

Figure 1:
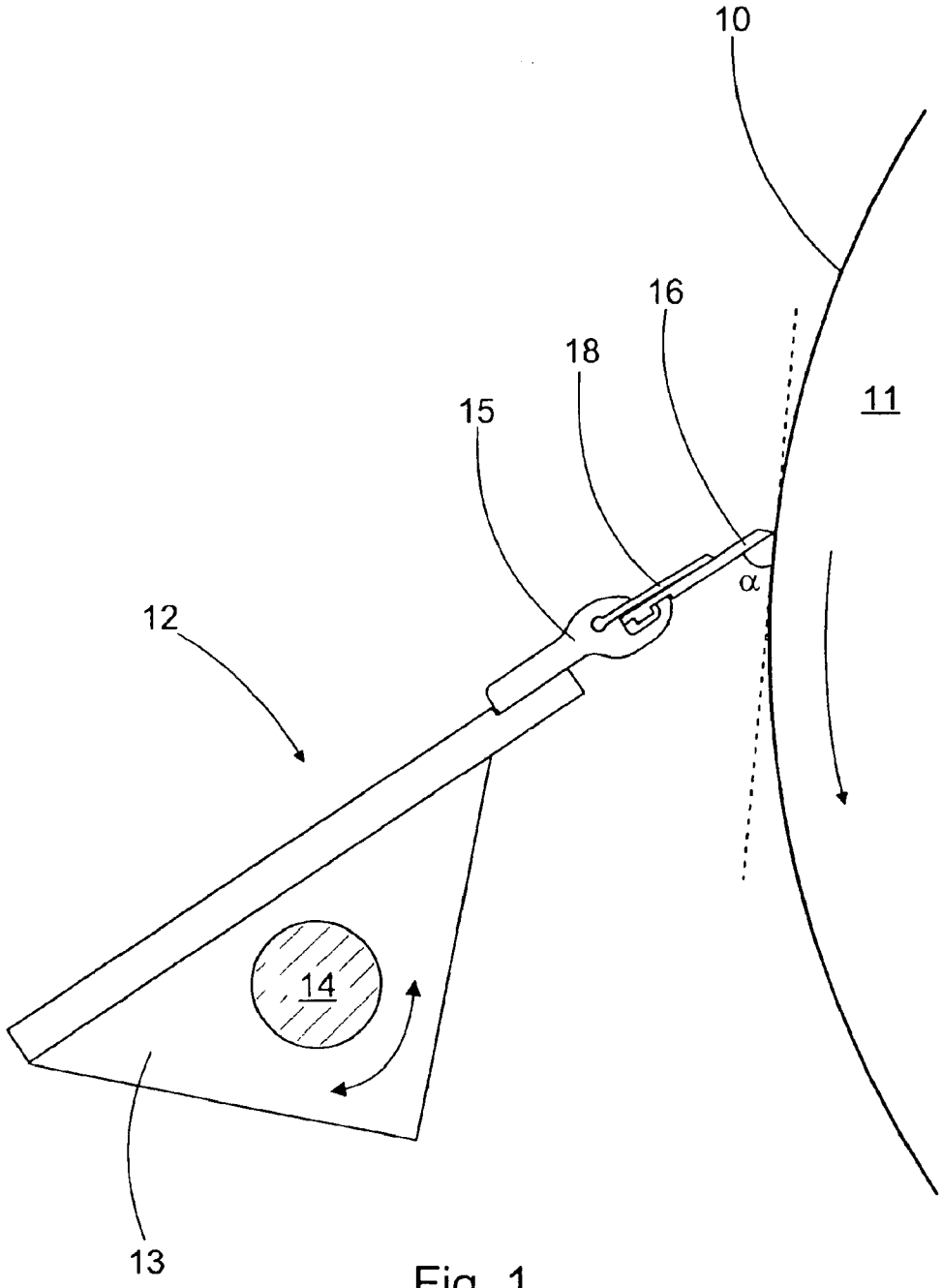
FIG. 1 shows a side view of the treatment equipment according to the invention arranged in connection with a moving surface.
Figure 2A:
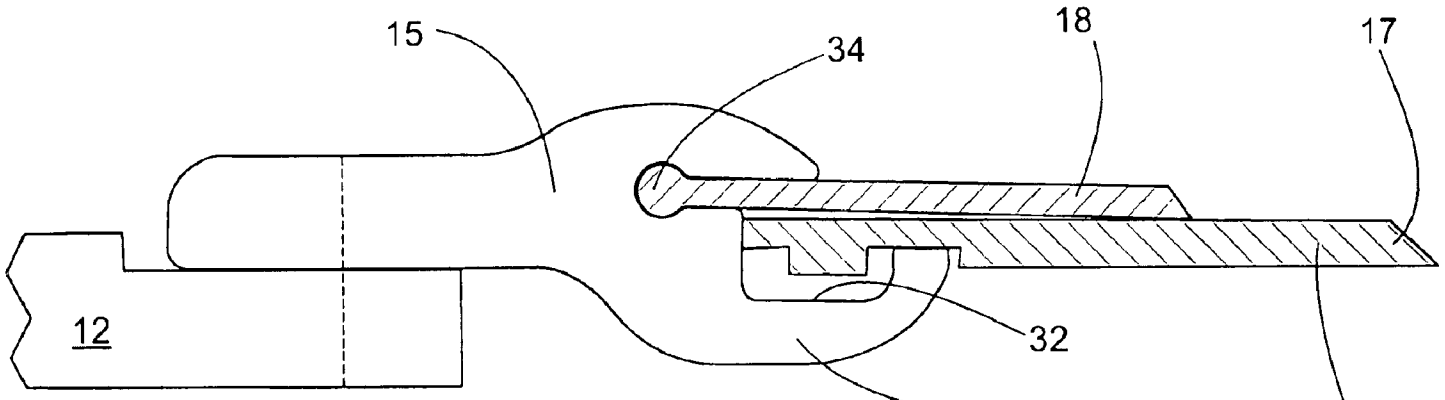
FIG. 2*a* shows an enlargement of the blade holder of FIG. 1.
Figure 2B:
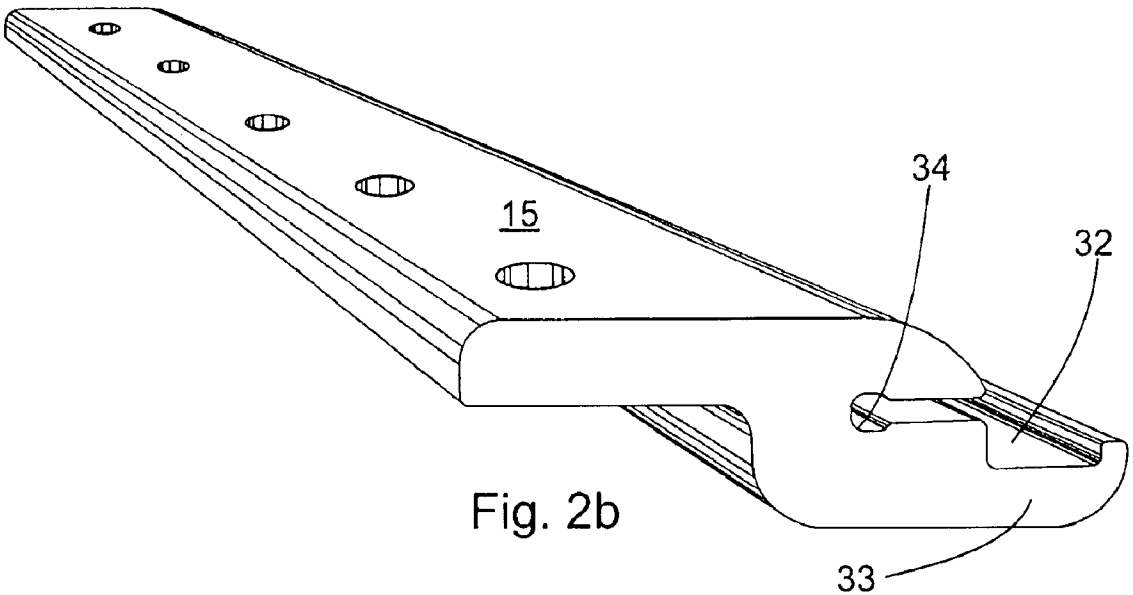
FIG. 2*b* shows a perspective view of an adaptation of the blade holder of FIG. 2*a*, without the blade.
Figure 6A:
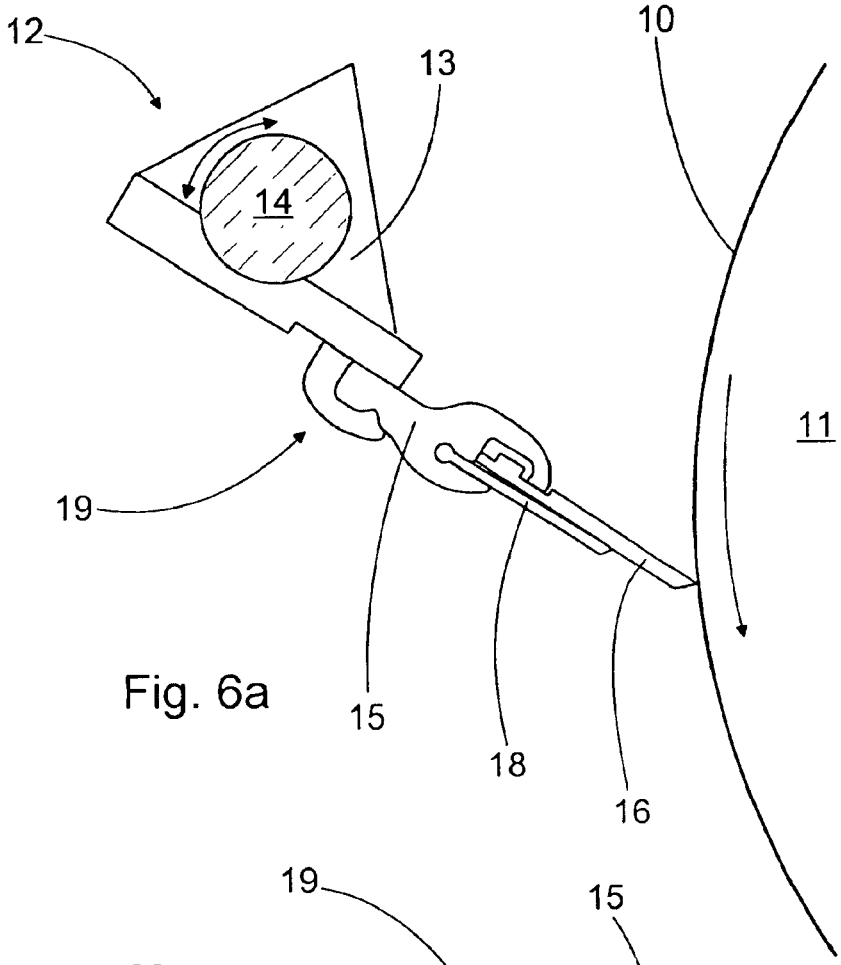
FIG. 6*a* shows a second embodiment of the treatment equipment according to the invention.

FIG. 1 shows the treatment equipment according to the invention, arranged in connection with a moving surface 10. In this case, the moving surface is a roll 11 of a paper machine, of which only a small part is shown. Generally, the treatment equipment is intended to treat a moving surface. In the doctor example, doctoring is used to remove impurities from the surface, or, for example in some positions in a paper machine, to remove the web itself. In paper, board, and other web-forming machines, the moving surfaces are also the surfaces of various cylinders and fabrics. The treatment equipment can also be used, for example, in web coating, in which a coating paste is applied to the surface of the moving web. This is shown in FIG. 6*a*. Further, the treatment equipment includes a frame 12, which is arranged in the vicinity of the surface 10 being treated. In FIG. 1, the frame 12 is a beam 13, which is supported rotatably on a shaft 14, from the structure of the paper machine. In practice, the beam is locked in the correct position, for example, using turnbuckle screws (not shown). On the other hand, loading members can be used to rotate the beam towards the surface, in order to improve the doctoring result.

The treatment equipment also includes a blade holder 15, which is attached to the frame 12 (FIG. 1). The actual treatment member is a blade 16 fitted to the blade holder 15, the dimensions and material of which can vary in different applications. The embodiments shown depict both a doctor blade and a coating blade. The blade 16 includes a doctoring bevelled edge 17, which is arranged to be brought into contact with the moving surface 10 by moving the blade holder 15. The moving surface is then treated. FIG. 1 shows a so-called rigid blade holder 15, in which case the blade holder 15 is moved by rotating the beam 13. In the blade holder 15 shown, there is also a separate backing blade 18, which is attached by one of its edges to the blade holder 15. Correspondingly, the other edge of the backing blade 18 extends closer than the blade holder 15 to the said bevelled edge 17, and thus supports the blade 16. The operation of the backing blade too is described in greater detail later. The blades 16 shown in the figure are unused. In a worn blade, the edge is bevelled in the other direction. On the other hand, in practice a bevel corresponding to that in a worn blade can be ground in the blade before use. In FIGS. 1 and 6*a*, the direction of movement of the surface 10 is shown with an arrow.

According to the invention, the blade holder 15 is surprisingly formed from a composite material essentially as a single piece. Such a blade holder is easy to manufacture and will easily withstand sudden impacts and will retain its shape even after large deformations. In addition, at least the composite material of the backing blade contains reinforcing fibres, more than 60% of which are arranged in the lateral direction of the blade. Thus the backing blade, and with it the blade, will conform well to the profile of the surface. Preferably the reinforcing fibres of the blade holder too have the same orientation as those in the backing blade. Thus the entire treatment equipment is advantageously flexible. Other advantages of the blade holder according to the invention will be described in greater detail later. The reinforcing fibres 35 of the backing blade 18, running in the lateral direction of the blade 16, are shown in FIG. 3*b*.

In the treatment equipment, the backing blade too has an essential significance. According to the invention, the backing blade 18 is similar to the blade 16. In addition, in the edge of the blacking blade 18 that fits into the blade holder 15, there is nib 34 with a locking shape, for securing the blacking blade 18 detachably to the blade holder 15. Thus, the backing blade has a quick-release attachment, so that it can be changed. In addition, the selection and manufacture of the blacking blade can exploit the know-how and manufacturing methods of blades, which will simplify the processing equipment and reduce costs.

Figure 3A:
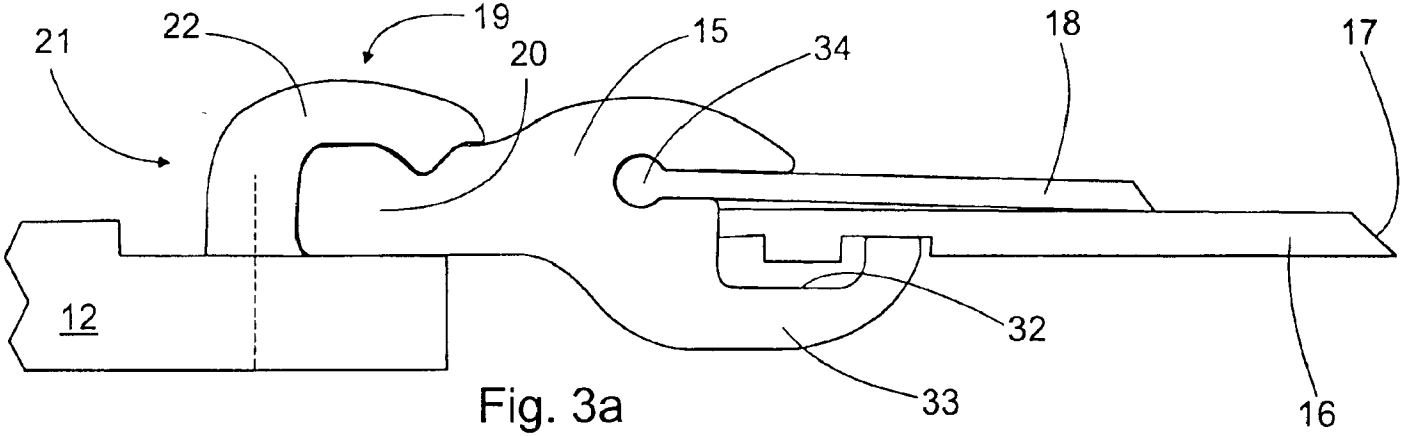
FIG. 3*a* shows an enlargement of a second embodiment of the blade holder of FIG. 1.
Figure 3B:
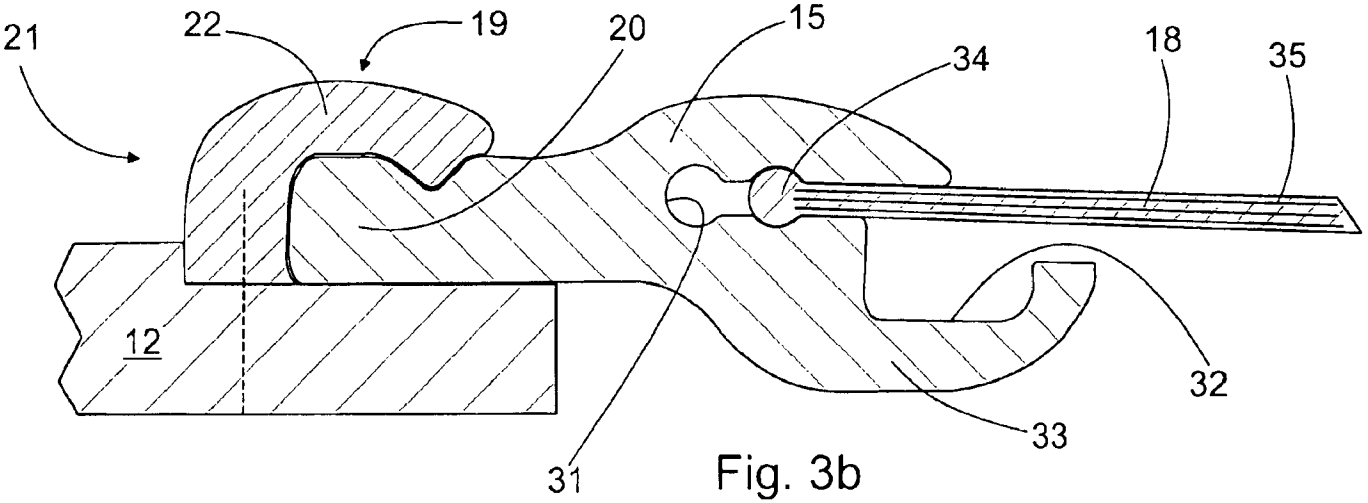
FIG. 3*b* shows a cross section of an adaptation of the blade holder of FIG. 3*a*, without a blade.

FIG. 3*b* shows an adaptation relating to the blacking blade 18. In it, the blade holder 15 has two attachment points 31 for the nib 34, in order to adjust the position of the backing blade 18 in the lateral direction of the blade 16. In other words, there are two alternative attachment points 31 in the blade holder 15 for attaching the backing blade 18. Thus, backing blades of two different sizes, for example, can be used in the blade holder. Secondly, the groove formed by the attachment point 31 can be used, for example, to lead lubricant onto the blade and from there onto the surface being treated. A pipe for the lubricant can, for instance, also be fitted to the groove, thus preventing the pressure from acting on the blade holder. In addition, the pipe can easily be made tight and the lubricant dosing will be precise.

According to the invention, the blade holder is also surprisingly detachably fitted to the frame 12 with the aid of a pair 19 of shape-locking attachment counter-pieces. The locking of the shapes of the attachment counter-pieces 20 and 21 is additionally arranged to hold the blade 16 stationary in its lateral direction and essentially free in the longitudinal direction of the blade 16. Thus, the blade holder can move in the longitudinal direction of the blade, i.e. in the cross-machine direction. In practice, in a paper machine for example, the blade holder can be fitted by simply pushing it in from the side and correspondingly removed by pulling it out. Despite the said quick-release, the shape locking holds in the lateral direction of the blade. Thus, the blade holder is certain to remain in place in the machine direction. During operation, for safety's sake, a locking pin, for example, can be used to prevent cross-machine movement. On the other hand, by selecting a suitable material, cross-machine movement can be exploited in oscillation. In that case, by only moving the blade holder, the blade can be made to move relative to the moving surface. Preferably, all of the components are of a composite material. This will avoid the scratching effect of metal rivets, for instance.

In the disclosed treatment equipment, in the first attachment counter-piece 20 of the pair 19 of attachment counter-pieces is a formed protrusion. Correspondingly, the second attachment counter-piece 21 is arranged to cover the first attachment counter-piece 20 from essentially the opposite sides. The said second attachment counter-piece 21 then forms a groove for the protrusion-like first attachment counter-piece 20. In principle, the positions of the attachment counter-pieces can be reversed. In the blade holder, it is, however, preferable to arrange the attachment counter-piece in the direction of the rear part of the blade holder. The blade is then attached to the front part of the blade holder. Here, the term front part refers to the part of the blade holder that is closest to the surface being doctored. By means of the disclosed construction of the attachment counter-pieces, the blade holder can be positioned freely and the blade holder can be given an optimal shape in terms of its loading and the blade attachment. At the same time, it avoids disadvantageous protrusions that would collect dirt and be liable to break.

Existing frames usually have ready threaded holes for attaching the blade holder. The second embodiment of the blade holder 15 can be easily attached with the aid of an adapter piece 22 according to the invention. Generally, one attachment counter-piece of the pair of attachment counter-pieces is thus arranged in a separate adapter piece, which is intended to be attached to the frame. In the figure, the attachment screws are shown by broken lines. The first embodiment of the adapter piece 22 is shown in FIGS. 3*a* and 3*b*. In this case, the adapter piece 22 forms, together with the frame 12, an attachment counter-piece 21 for the protrusion-like attachment counter-piece 20 formed in the blade holder 15. The shown construction is especially compact and the adapter piece 22 is easy to attach to the frame 12. In practice, it is preferable to shape the blade holder already during manufacture, so that the construction of the blade holder will remain unified. The same reference numbers are used for components that are operationally similar.

Figure 4A:
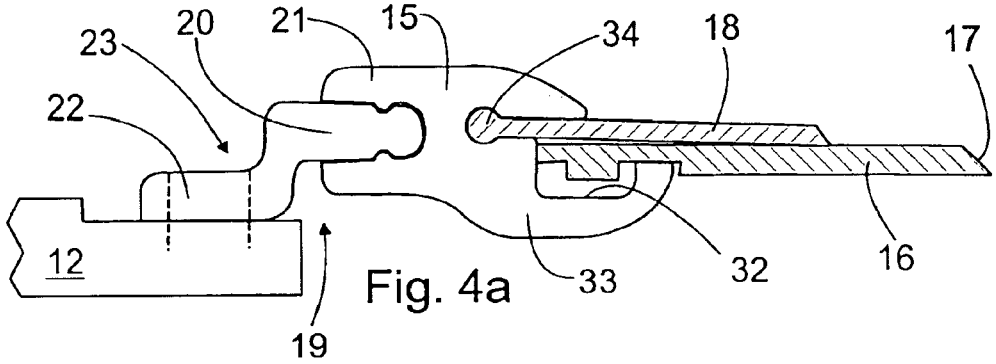
FIGS. 4*a*–4*d* show various examples of embodiments of the blade holder according to the invention.
Figure 4B:
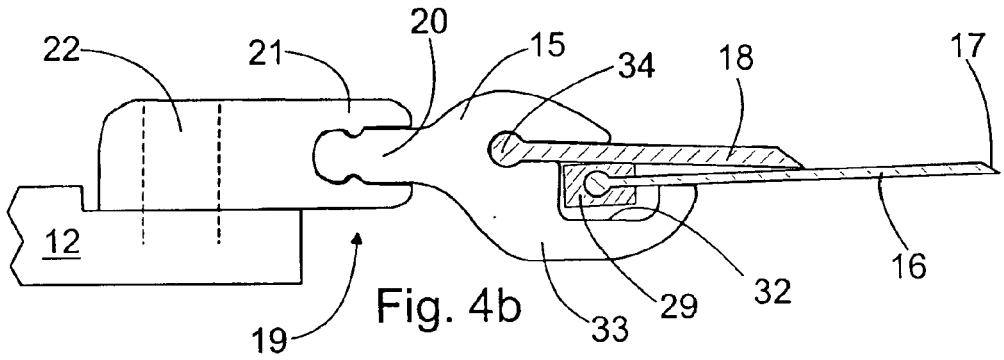

The next embodiments of the adapter piece 22 are shown in FIGS. 4*a* and 4*b*. In this case, one of the attachment counter-pieces 20 or 21 is formed entirely in the adapter piece 22. Thus the adapter piece 22 can be attached permanently to the frame 12. In FIG. 4*a*, a protrusion-like attachment counter-piece 21 is formed in the adapter piece 22, the groove-like attachment counter-piece 21 being in the blade holder 15. Thus the shape locking is well protected from dirtying. In addition, the blade holder 15 can be shaped advantageously in terms of manufacturing. In the treatment equipment of FIG. 4*a*, there is also a bend 23 in the adapter piece 22, which compensates for the difference in the position of the blade 16 relative to a conventional blade holder. On account of the adapter piece 22, the blade 16 extends closer to the surface 10, so that the angle a of the blade 16 relative to the surface changes. According to FIG. 1, when the blade holder 15 is lengthened, the blade angle a diminishes, which generally has a negative effect on the doctoring result. By moving the blade holder vertically, the said problem is avoided, or at least it can be avoided by adjusting the beam and its position. If necessary, the adapter piece with the bend can also be positioned the other way round in the frame. The size and shape of the bend can also vary in different embodiments.

For example, when manufacturing new treatment equipment according to the invention, an adapter piece is not necessary. This is possible by arranging one of the attachment counter-pieces 20 or 21, of the pair 19 of attachment counter-pieces, in the frame 12. This is show by the embodiments of FIGS. 4*c* and 4*d*. Particularly the blade holder of FIG. 4*d* can be made especially short, permitting it to be located in cramped positions.

Figure 5A:
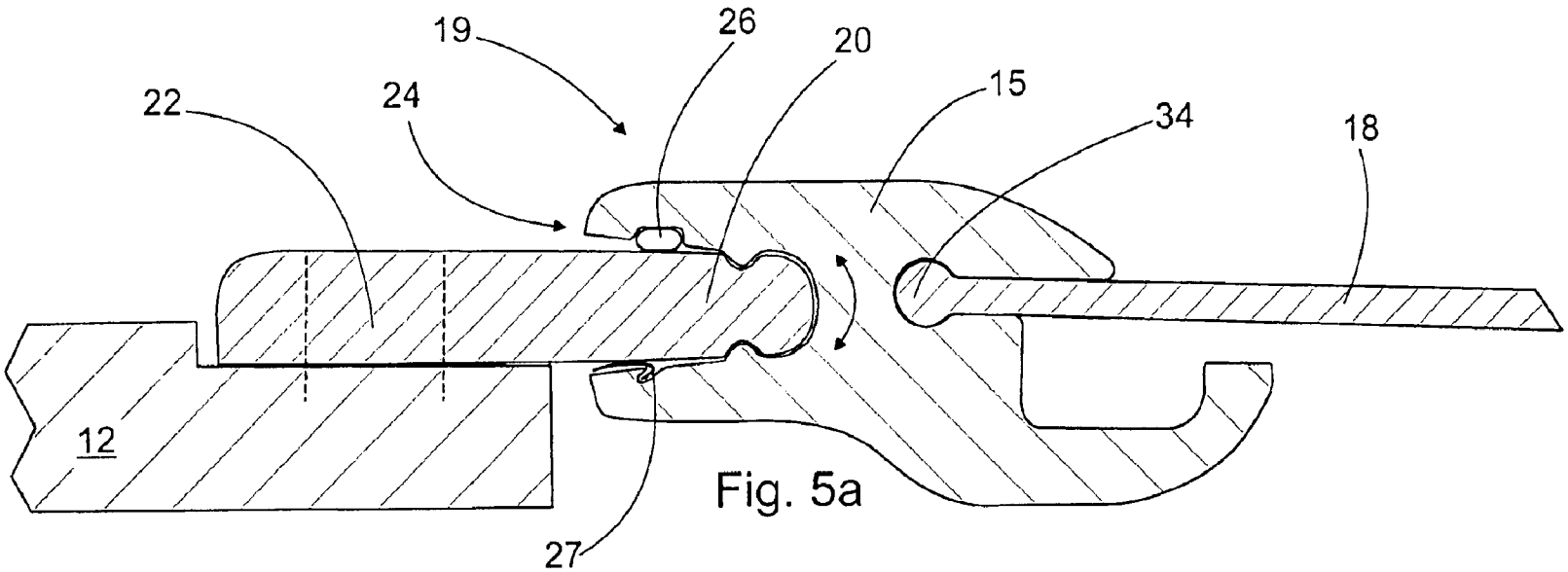
FIG. 5*a* shows a cross section of a blade holder according to the invention, equipped with loading members.

Nowadays, adjustable blade holders are also used, in which the frame remains stationary while the blade holder rotates. In addition to the rigid blade holders described above, the blade holder according to the invention can also be arranged to be adjustable. Generally, the attachment counter-pieces of the pair of attachment counter-pieces are arranged to form an operational pivot between each other. Thus, the angle between the attachment counter-pieces can be changed while the lateral locking of the blade remains unchanged. FIG. 5*a* shows an adjustable, or more accurately a loadable embodiment of the blade holder 15. The blade holder 15 in question corresponds in principle to the blade holder shown in FIG. 4*a*, but the shape of the attachment counter-piece 21 of the blade holder 15 is more open. Thus, the shape locking is retained while, however, permitting the blade holder to move. To create the movement, there are loading members 24 between the attachment counter-piece 20 and the blade holder 15. In the embodiment of FIG. 5*a*, the loading members 24 are between the adapter piece 22 and the blade holder 15.

Figure 5B:
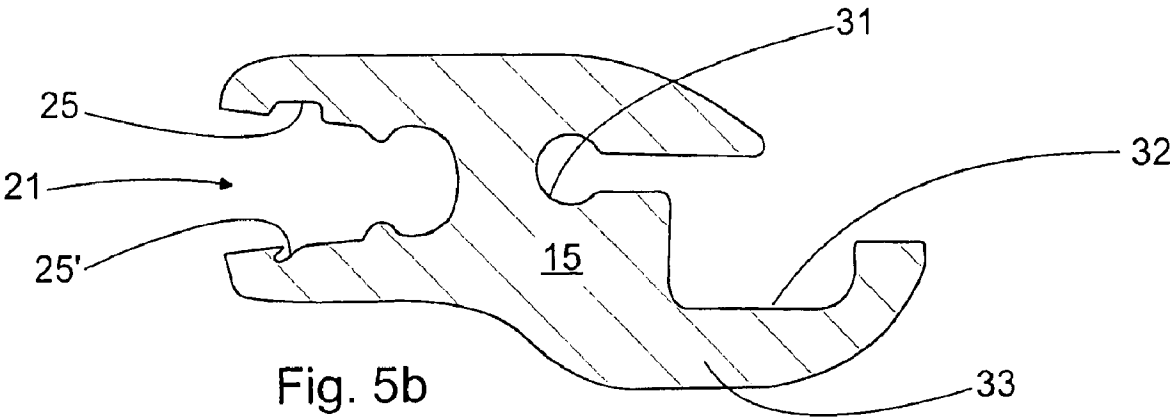
FIG. 5*b* shows only the blade holder of FIG. 5*a*.

A tight construction may make it difficult to find a location for the loading members. The lack of space can be avoided by arranging a recess for the loading members in either or both of the attachment counter-pieces. In FIG. 5*a*, there are recesses in the blade holder 15 on both sides of the adapter piece 22. In the upper recess, there is an, as such known, loading hose 26 and the lower recess there is a spring piece 27. FIG. 5*b* shows both the upper recess 25 and the lower recess 25' in greater detail. The treatment equipment in question is arranged in such a way that the spring piece 27 tries to turn the blade 16 upwards. Correspondingly, the blade 16 is loaded against the surface by adjusting the pressure in the loading hose 26. The movement of the blade holder 15 is shown by an arrow in FIG. 5*a*, in which the solution shown is particularly advantageous in new treatment equipment according to the invention. Only one loading hose is then needed to operate the blade holder. For existing treatment equipment incorporating two loading hoses, a blade holder with recesses for two loading hoses (not shown) can be selected.

Figure 6B:
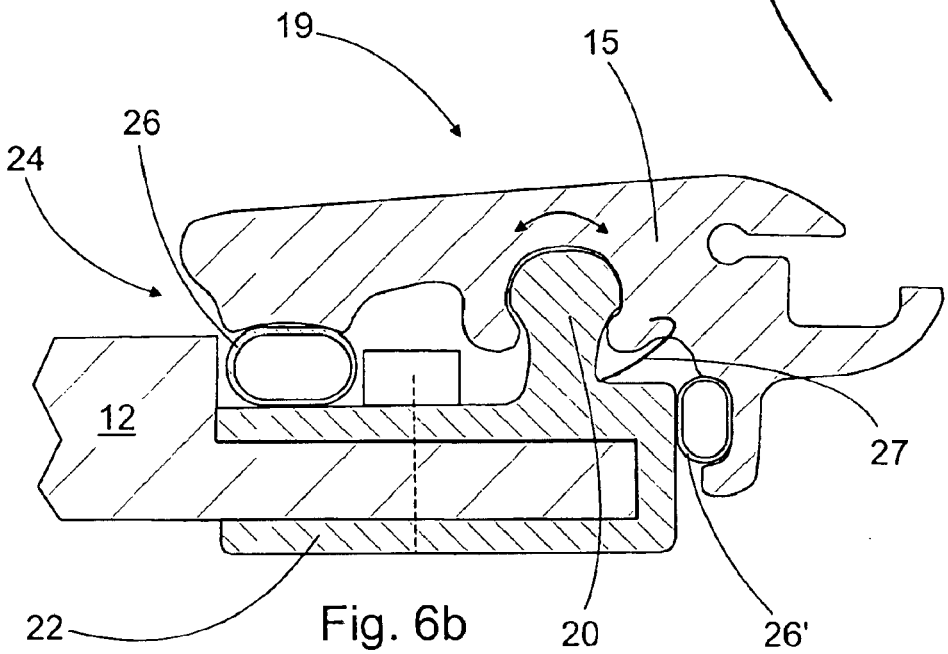
FIG. 6*b* shows a second embodiment of the blade holder equipped with loading members, FIG. 7 perspectively shows a third embodiment of the blade holder equipped with loading members.
Figure 7:
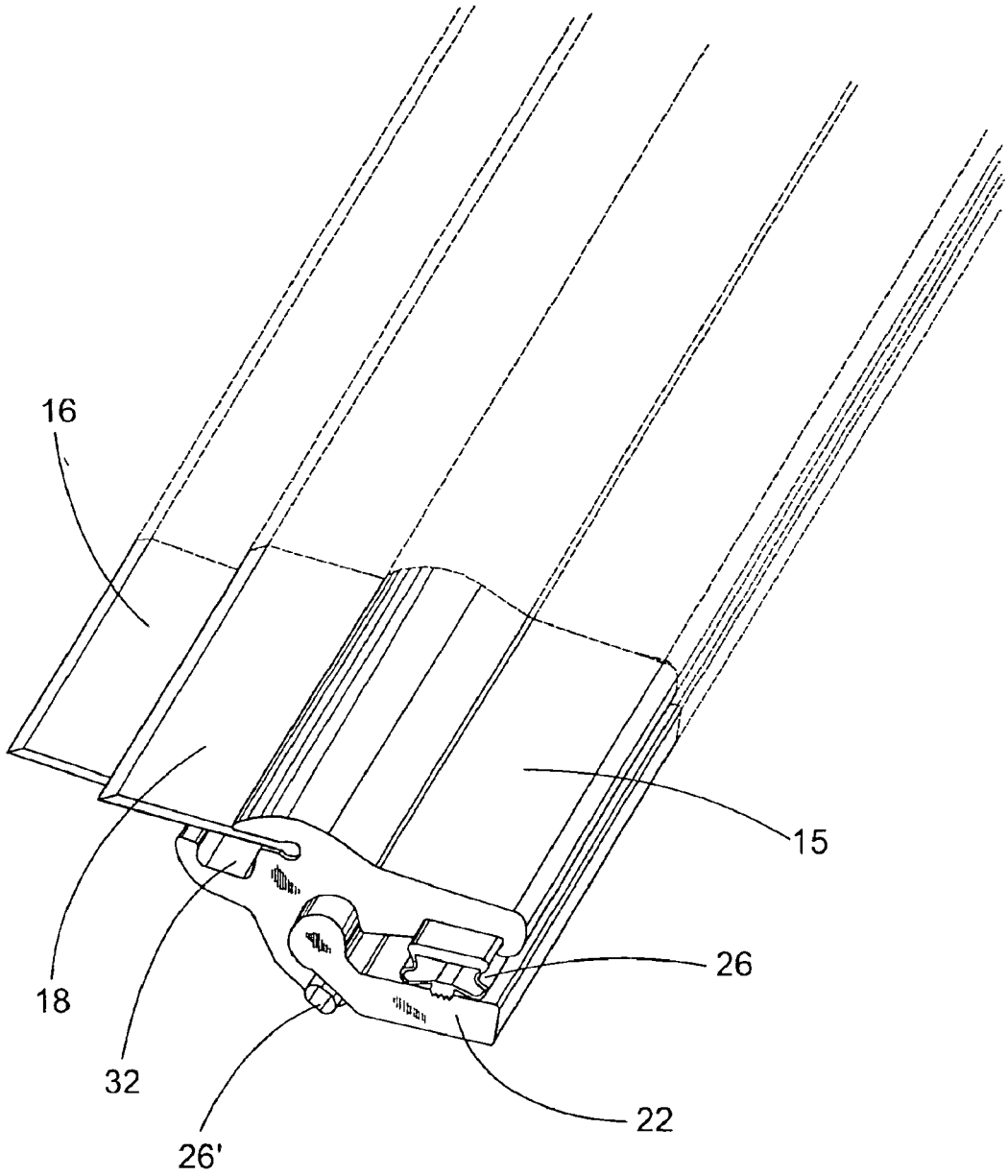
Figure 8A:
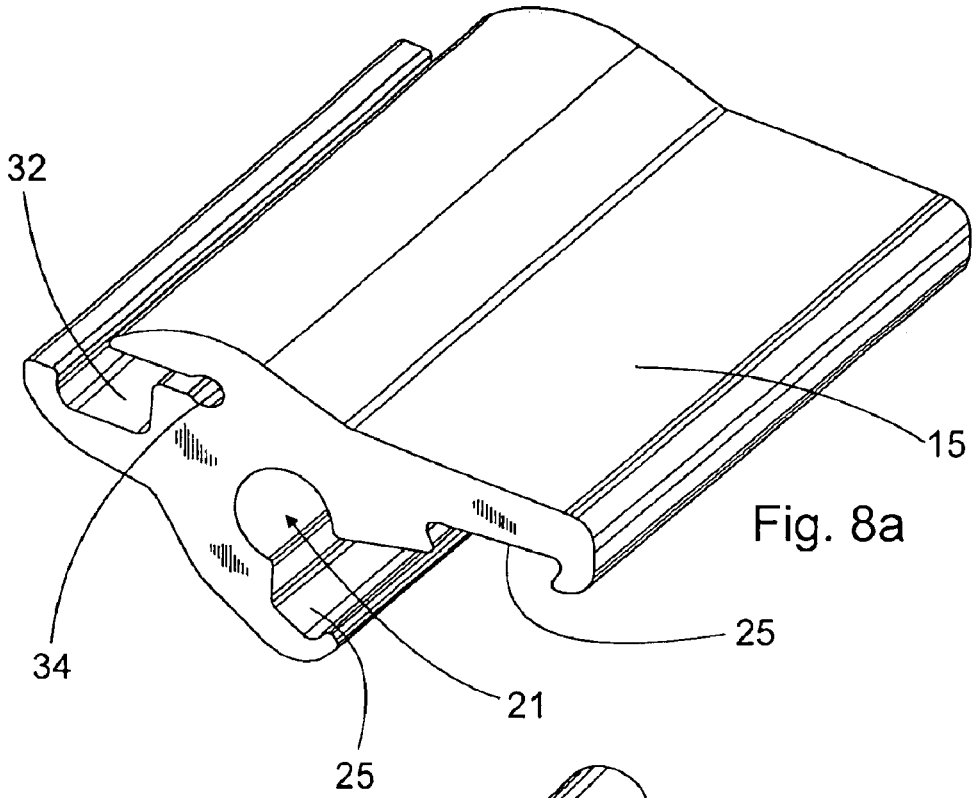
FIGS. 8*a*–8*b* show the blade holder and the adapter piece of FIG. 8.
Figure 8B:
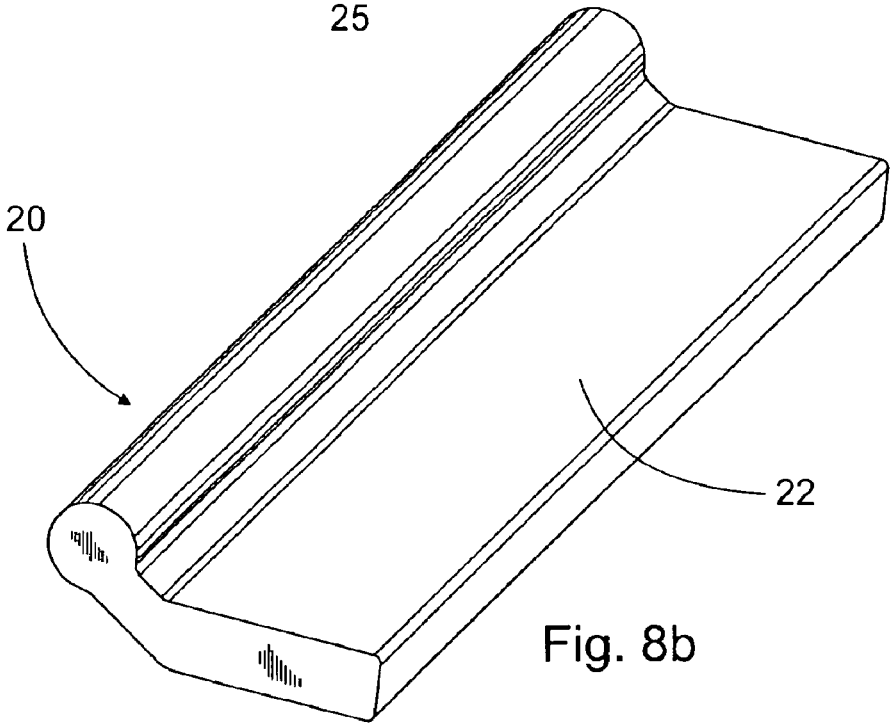

FIG. 6*b* shows a second embodiment of the loadable blade holder. In this case too, the blade holder 15 is moved with the aid of loading hose 26. Correspondingly, the return force is created using a second loading hose 26' or a spring piece 27. Here, the adapter piece 22 extends to both sides of the frame 12. The attachment is secured by screws. FIG. 7 shows a third embodiment of the loadable blade holder. In this embodiment there are also two loading hoses 26 and 26'. The blade holder 15 and the adapter piece are very slender without any extra protrusions. Thus the treatment equipment remains clean even in dirty conditions. FIG. 8*a* shows the blade holder 15 and the FIG. 8*b* shows the adapter piece 22 according to the invention.

Figure 4C:
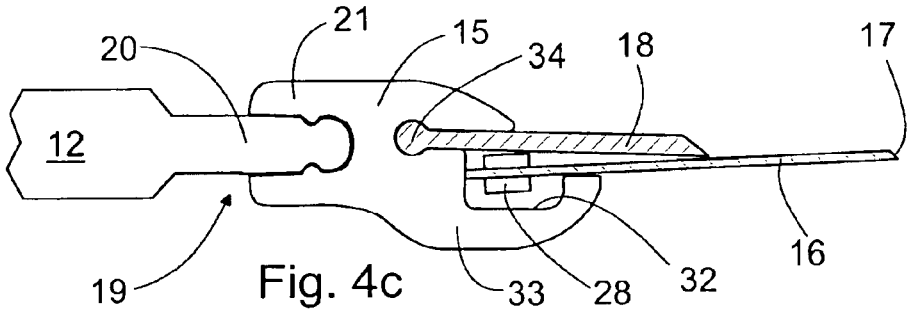
Figure 4D:
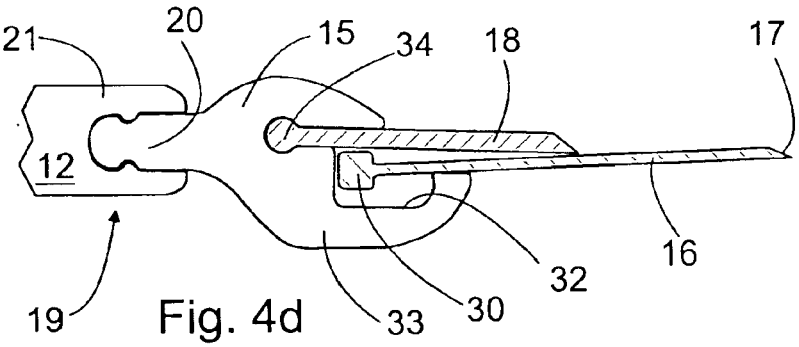

The blade holder according to the invention is shaped so that various kinds of blades can be fitted to it. FIG. 4*a* shows a thick plastic blade while FIGS. 4*b*–4*d* show thin metal or composite blades. The shaping of the blade holder allows thin blades to be attached in several different ways. In FIG. 4*c* there is a conventional rivet 28, whereas FIG. 4*b* shows a composite blade attached using a special adapter 29. In the corresponding composite blade of FIG. 4*d*, there is a larger and differently shaped extension 30 in the rear part, making a separate adapter is unnecessary. For the blade 16, there is also a throat 32, which is delimited by a jaw 33 in addition to the backing blade 18.

Overall, the manufacture of the treatment equipment according to the invention is simpler than previously. Preferably all the components are manufactured using the pultrusion method. The components are then ready for use without extensive machining. In addition, pultrusion allows the reinforcing fibres to be placed in a specific way.

Preferably, there are considerably fewer cross-machine direction fibres than machine-direction fibres. Thus, the blade, the backing blade, the blade holder, and possibly the adapter piece will conform to the shapes of the surface being doctored. In other words, the entire treatment equipment is controllably flexible in the cross-machine direction. Among other things, this eliminates vibration problems in the treatment equipment and uneven blade wear. In addition, the known micro-screws intended for adjusting the profile are unnecessary. On the other hand, as most of the fibres are in the machine direction the treatment equipment can be loaded against the surface. In other words, the components are rigid in order to transmit force.

The construction described above also permits the rapid adjustment of the treatment equipment. Various kinds of blade holders can be attached to the frame, allowing various kinds of blades and backing blades to be correspondingly changed. Thus changing the components will provide a combination that will suit the current position. The detachable backing blade also allows the blade holder to be cleaned throughout. This can be easily done outside the machine too, as the entire blade holder can be simply removed from the machine.

Composite-construction treatment equipment is also advantageous in terms of operation. First of all, the blade holders that have been tested weigh, for example, only about 3 kg/m, so that they have no deflection due to their own weight. In addition, the blade holder can be installed manually in the treatment equipment without using hoists or other support. Further, the composite construction is highly resistant to sudden impacts and will regain its shape after even large deformations. On the other hand, if it breaks, the composite construction breaks at once, thus acting as a kind of fuse. If the blade holder breaks, it can be rapidly replaced with a new one without a long period of crippled operation of the treatment equipment. Breakage will also save the other structures of the treatment equipment. The operation of the treatment equipment can also be easily monitored, by installing, for example, membrane sensors between the blade and the backing blade, allowing the profile of the loading pressure to be determined.

The treatment equipment according to the invention is simple to manufacture, but versatile in use. In addition, the installation of the treatment equipment and the replacement of its components are rapid, which cuts production breaks. Particularly the blade holder is light, making it easy to store and especially easy to handle. The operation of the blade holder also requires less force than before. Being able to combine different components to form a suitable combination for the current use is also important. Thus, the required doctoring result can be obtained in each position, even when the geometry of the position changes, for example, when a roll is replaced with one of a different diameter. In addition, even when the production parameters change, the treatment equipment can be reset during a grade-change shutdown, which is completely impossible in treatment equipment according to the state of the art.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A doctor arrangement, which is intended to be installed in connection with a moving surface and which doctor arrangement includes a frame, which is arranged in the vicinity of the said surface, a blade holder, formed from composite material as a single piece and connected to the frame, a blade fitted to the blade holder, a bevelled edge of which blade is arranged to be brought into contact with the moving surface by moving the blade holder, and a separate backing blade fitted to the blade holder, which is fitted at one edge into the blade holder, the other edge extending closer than the blade holder to said bevelled edge, the blade holder is arranged detachably in the frame, by means of a locking-shape pair of attachment counter-pieces, in which the shape-locking is arranged to hold the blade in its lateral direction and to be essentially free in the longitudinal direction of the blade.

2. The doctor arrangement according to claim 1, characterized in that the backing blade is formed from a composite material including reinforcing fibres, of which more than 60% are arranged to run in the lateral direction of the blade.

3. The doctor arrangement according to claim 1, characterized in that the backing blade is similar to the blade and also that, in its edge to be fitted into the blade holder, a shape-locking recess is formed for attaching the backing blade detachably to the blade holder.

4. The doctor arrangement according to claim 3, characterized in that, in the blade holder there are at least two attachment points for the recess for adjusting the position of the backing blade in the lateral direction of the blade.

5. The doctor arrangement according to claim 1, characterized in that a first attachment counter-piece of the pair of attachment counter-pieces is a shaped protrusion and a second attachment counter-piece of the pair of attachment counter-pieces is arranged to cover essentially from the opposite sides.

6. The doctor arrangement according to claim 1, characterized in that in the blade holder, the attachment counter-piece is arranged in a rear part parallel to the blade holder, the blade being attached to a front part of the blade holder.

7. The doctor arrangement according to claim 1, characterized in that one attachment counter-piece of the pair of attachment counter-pieces is arranged in a separate adapter piece, which is intended to be attached to the frame.

8. The doctor arrangement according to any of claim 1, characterized in that one attachment counter-piece of the pair of attachment counter-pieces is arranged in the frame.

9. The doctor arrangement according to claim 1, characterized in that the attachment counter-pieces are arranged to form an operational pivot between them, so that the angle between the attachment counter-pieces can be changed while the possible lateral locking of the blade remains unchanged.

10. The doctor arrangement according to claim 9, characterized in that there are loading members between the attachment counter-piece and the blade holder.

11. The doctor arrangement according to claim 10, characterized in that, in either or both of the attachment counter-pieces there is at least one recess for the loading members.

12. The doctor arrangement according to claim 10, characterized in that the loading members comprise loading hoses and/or spring pieces.

* * * * *